US005752147A

United States Patent [19]

in't Zandt

[11] Patent Number: 5,752,147

[45] Date of Patent: May 12, 1998

[54] ROLLER FUSER ASSEMBLY FOR REPRODUCTION SYSTEMS

[75] Inventor: Hubertus W. G. in't Zandt, Venlo, Netherlands

[73] Assignee: Océ-Nederland B.V., Venlo, Netherlands

[21] Appl. No.: 815,847

[22] Filed: Mar. 12, 1997

[30] Foreign Application Priority Data

Mar. 12, 1996 [NL] Netherlands ..... 1002579

[51] Int. Cl.[6] ..... G03G 15/20

[52] U.S. Cl. ..... 399/325; 399/324; 118/DIG. 1

[58] Field of Search ..... 399/324, 325, 399/327; 118/60, DIG. 1

[56] References Cited

U.S. PATENT DOCUMENTS

| | | | |
|---|---|---|---|
| 4,231,653 | 11/1980 | Nagahara et al. | 399/325 |
| 4,429,990 | 2/1984 | Tamary . | |
| 4,870,446 | 9/1989 | Bickerstaff et al. | 137/807 |
| 4,994,862 | 2/1991 | Hoover | 399/325 |
| 5,146,271 | 9/1992 | Hoover | 399/24 |
| 5,155,534 | 10/1992 | Kurotori et al. . | |
| 5,160,970 | 11/1992 | Isogai | 399/70 |
| 5,353,107 | 10/1994 | Sculley et al. | 399/43 |

FOREIGN PATENT DOCUMENTS

| | | |
|---|---|---|
| 0238845 | 2/1987 | European Pat. Off. . |
| 0628922 | 5/1994 | European Pat. Off. . |
| 56-081875 | 7/1981 | Japan . |
| 56-119163 | 9/1981 | Japan . |
| 2-163785 | 6/1990 | Japan . |
| 3-083086 | 4/1991 | Japan . |
| 5-107973 | 4/1993 | Japan . |
| 5-127555 | 5/1993 | Japan . |
| 5-158372 | 6/1993 | Japan . |
| 7-334025 | 12/1995 | Japan . |

OTHER PUBLICATIONS

"Release Oil Storage and Delivery System" published in *Research Disclosure* Sep. 1981.

*Primary Examiner*—Matthew S. Smith

*Attorney, Agent, or Firm*—Birch, Stewart, Kolasch & Birch, LLP

[57] ABSTRACT

A roller fuser assembly for reproduction systems, including at least two fuser rollers for pressing against their pressure surfaces a printing sheet fed therealong in order to fix toner images present on at least one side of said printing sheet, by the action of pressure and heat. A device applies a release liquid to the pressure surfaces of the fuser rollers. A release liquid container is provided for each fuser roller wherein the two release liquid containers are oblique with respect to one another and are connected to one another by an inclined release liquid collecting and discharge plate. This plate is connected, for liquid discharge, to at least one of the release liquid containers.

20 Claims, 3 Drawing Sheets

ROLLER FUSER ASSEMBLY FOR REPRODUCTION SYSTEMS

FIELD OF THE INVENTION

The invention relates to a roller fuser assembly for fusing toner powder on an image receiving material by means of pressure and heat.

DESCRIPTION OF THE BACKGROUND ART

Fixing toner powder on an image receiving material or printing sheet is generally effected by feeding the printing sheet between a heated roller or fuser roller and a pressure roller. In these conditions the toner powder comes into contact with the fuser roller. To prevent the image receiving material from sticking to the fuser roller, a release liquid, such as silicone oil, is applied to the fuser roller.

A system of this kind is used in reproduction systems, such as a copying machine, adapted for making simplex copies. The same arrangement, however, is also suitable for reproduction systems in which duplex copies are reproduced, in which after being printed on one side the image receiving materials are fed between the nip formed between the fuser roller and the pressure roller, then deflected, returned and turned over, printed on the second side, and then, again with the second side against the fuser roller, are again fed through the nip. An arrangement of this kind is known inter alia from Netherlands Patent Application 93 00981.

In an alternative arrangement for printing systems with which duplex copies can be made, both rollers are operative as a fuser roller, both sides of the image receiving material being simultaneously heated and pressed in order to fix the toner powder thereon. Examples of this arrangement are described and illustrated in Research Disclosure (RD) 20909 of September 1981 and U.S. Pat. No. 4,429,990. Both fuser rollers then have to be provided with release liquid.

Reproduction systems can therefore involve a single fuser roller and pressure roller assembly or a fuser roller and fuser roller assembly, although a double arrangement is possible, in which the first fuser roller and pressure roller assembly is followed by a second fuser roller and pressure roller assembly for duplex copies as well. An assembly of this kind can also serve as an extra after-fuser step for image receiving materials which have already been subjected to a previous fusing operation carried out elsewhere. The invention relates to these single or double roller assemblies involving two fuser rollers.

The roller fuser assembly according to RD20909 is constructed as a fuser roller and fuser roller assembly. The two fuser rollers are disposed one above the other and a tray with release liquid is disposed above the top fuser roller and below the bottom fuser roller, from which tray a wick projects to contact the pressure surface of the adjacent fuser roller. The liquid containers are provided with liquid by means of liquid feed conduits originating from a liquid reservoir. The wicks are pressed against the fuser rollers by means of compressed air in order to deliver release liquid. Any excess release liquid on the fuser rollers can flow down by gravity or drop to the reservoir disposed beneath the bottom fuser roller.

The arrangement according to U.S. Pat. No. 4,429,990 also comprises a fuser roller/fuser roller assembly. A hollow porous liquid feed roller is disposed at each fuser roller and is provided with liquid by means of a separate feed conduit extending from a liquid reservoir. The hollow porous feed rollers can be brought into contact with the pressure surface of the fuser rollers by means of compressed air.

As already indicated above, release liquid can drop off the fuser rollers inter alia. Unwanted liquid leakages can also occur at the oil feed conduit connections. Steps should be taken to prevent such leakage from soiling parts of the reproduction apparatus. Systems of this kind are therefore also equipped with special leakage trays. In the arrangement according to RD20909, the reservoir acts as such with respect to liquid originating from the fuser rollers. However, this is effected in a somewhat uncontrolled manner and then only with the two fuser rollers disposed purely vertically above one another. Liquid originating from leakages in the liquid feed conduits and not reaching the fuser rollers is not collected by the reservoir.

SUMMARY OF THE INVENTION

The object of the invention is to provide an improvement in this respect, and for this purpose provides a roller fuser assembly for reproduction systems. The assembly comprises at least two fuser rollers with pressure surfaces for pressing against a printing sheet fed therealong in order to fix toner images present on at least one side of said printing sheet, by the action of pressure and heat. The assembly further comprises means for applying a release liquid to the pressure surfaces of the fuser rollers, and a release liquid container for each fuser roller. The two release liquid containers are interconnected by a release liquid collecting and discharge plate connected, for the discharge of release liquid, to at least one of the release liquid containers.

The space between the two release liquid containers can also be sealed by the collecting and discharge plate against any liquid leakage. The two containers and plate can form a simple unit to construct. In this way not only is liquid leakage reliably counteracted, but there is a saving in respect of facilities and space in the reproduction apparatus.

Preferably, the fuser rollers are disposed at different heights and the collecting and discharge plate is connected, for release liquid, to the release liquid container of the bottom fuser roller. In this case, preferably, the bottom fuser roller is disposed obliquely beneath the top fuser roller, while in addition, preferably, the collecting and discharge plate forms an inclined plane. In the event of leakage from the top fuser roller, the liquid can readily flow away via the collecting and discharge plate to the zone of the release liquid container of the bottom fuser roller.

Preferably, the release liquid container of the bottom fuser roller is disposed to receive release liquid flowing along the plate. This liquid can, as it were, automatically become available for re-use.

Preferably, the release liquid container of the top fuser roller is provided with an overflow edge connected, for discharge, to the collecting and discharge plate, wherein the release liquid container of the bottom fuser roller is provided with a discharge to a release liquid reservoir, and wherein a feed conduit extends between the reservoir and the release liquid container of the top fuser roller. The release liquid can then be fed — in excess — from the reservoir to the top release liquid container and then overflow therefrom, flow off via the plate and then be collected in the release liquid container of the bottom fuser roller. In this way the release liquid intended for the two fuser rollers can be fed through one feed conduit and the collecting and discharge plate can perform an extra function in the feed conduit for release liquid to the release liquid container of the bottom fuser roller.

In these conditions, it is possible to fix the feed conduit to the top fuser roller on the plate, at the top thereof. If, for any reason whatsoever, liquid should leak from the feed conduit, it is immediately collected by the plate and discharged to the reservoir.

Preferably, the release liquid containers and the collecting and discharge plate form a unit with one another. The reservoir for release liquid can be fixed on the plate. The same applies to the pump means by means of which the release liquid is pumped through the feed conduit. The collecting and discharge plate in these conditions fulfills an extra function, i.e. as assembly means.

In another development of a roller fuser assembly according to the invention, the collecting and discharge plate is provided with a passage opening for a printing sheet, wherein the passage opening as considered in the processing direction is situated upstream of the fuser rollers. As a result, the fuser rollers can be fitted close to the plate because there is no need to reserve space between the fuser rollers and the plate for special movements of the printing sheet.

Preferably, the plate at the passage opening is provided with means for keeping release liquid away from the passage opening, said means preferably forming a bent-over edge zone in the plate, which also forms a printing sheet guide in the passage opening.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DEATAILED DESCRIPTION OF THE PREFERRED EMBODIMENTS

Figure 1:
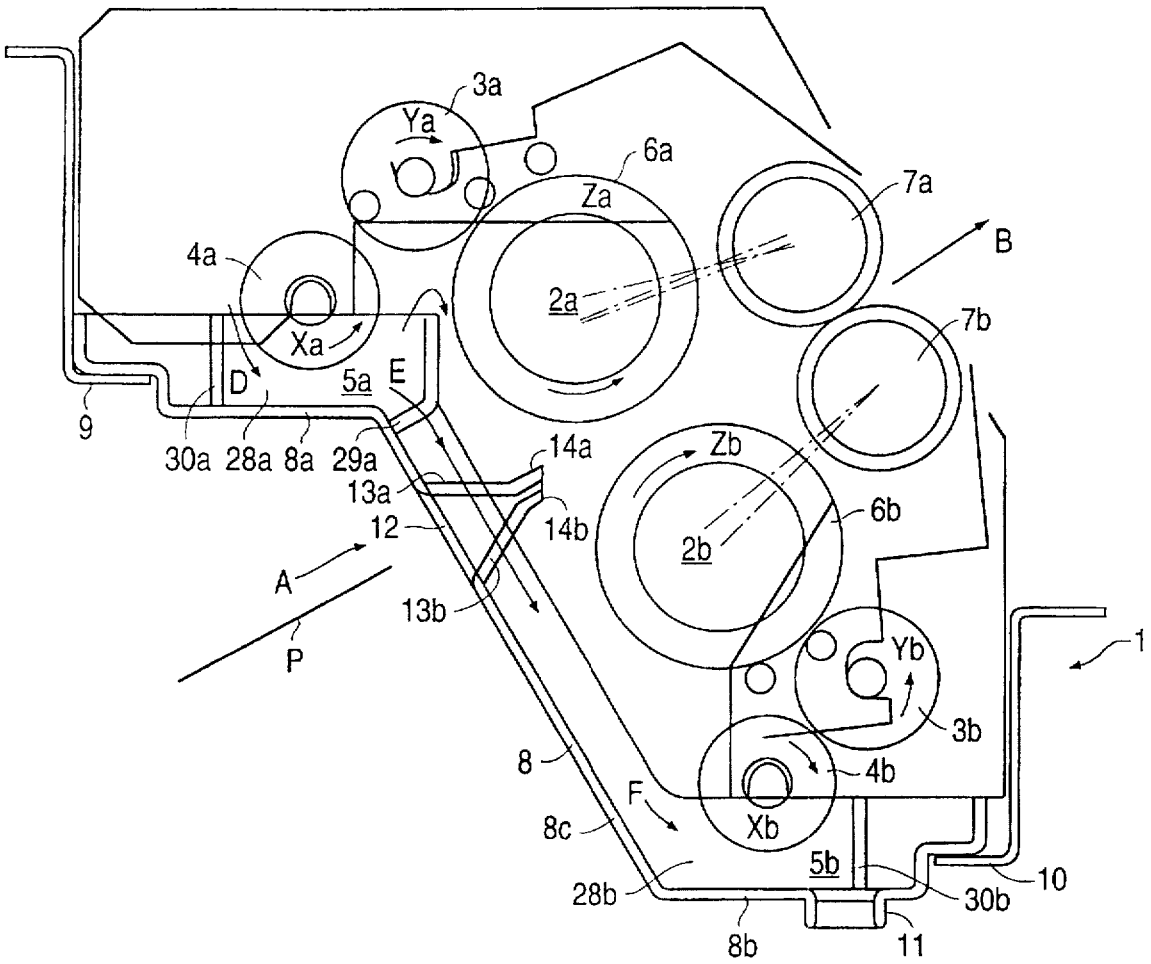
FIG. 1 is a diagrammatic vertical section through part of the roller fuser assembly according to the invention.

FIG. 1 illustrates the exemplified embodiment of a roller fuser assembly 1 according to the present invention. The assembly 1 is accommodated in a reproduction system at a place in the process downstream of the place where the image for reproduction is applied in toner powder to an image receiving material or printing sheet. It is immaterial to the invention how the toner powder is applied to the image receiving material. What is important is that the toner powder is additionally compressed by pressure and heat to the image receiving material to give good adhesion and coverage.

In FIG. 1, the roller fuser assembly 1 is provided with a metal casing 8 having a top plate part 8*a* in the form of a step and a bottom plate part 8*b* in the form of a step, and an intermediate plate part 8*c* which connects the parts together in order to form a unit therewith. The top plate part 8*a* forms the base of the top release liquid container 28*a* which, as considered in the drawing, is bounded on the left by the upright wall 30*a* and on the right by the upright wall 29*a*. The bottom plate part 8*b* forms the base of a bottom release liquid container 28*b* which, as considered in the drawing, is bounded on the right by the upright wall 30*b* and on the left by the oblique plate part 8*c*.

At the top and bottom ends of the plate 8, the latter is fixed by suitable supports 9 and 10 in a manner not shown in detail, in the reproduction system (also not shown). It will be understood that this attachment can be accomplished in many ways.

Release liquid dispensing rollers 4*a* and 4*b* are disposed in manner not shown in detail so that their surfaces are immersed in the liquid in the top and bottom containers 28*a* and 28*b* respectively. The rollers 4*a* and 4*b* can be rotated in the directions Xa and Xb by conventional technical means. The dispensing rollers 4*a* and 4*b* can be brought into contact with respective feed rollers 3*a* and 3*b* by suitable means, which are shown only diagrammatically, said rollers 3*a* and 3*b* themselves being rotatable in the directions Ya and Yb and in turn adapted to be brought into contact with the surfaces of the fuser rollers 2*a* and 2*b*, which are provided with means for heating their surface.

The fuser rollers 2*a* and 2*b* are so disposed that they can be moved towards one another to form a nip between which a printing sheet P coming from the direction A can be gripped. The fuser rollers 2*a* and 2*b* are rotated in the directions Za and Zb in order to feed the printing sheet P in the direction B.

Downstream of the fuser rollers 2*a* and 2*b* two transport rollers 7*a* and 7*b* are disposed to provide further transport in the direction B.

To be able to receive a printed image receiving material between the fuser rollers 2*a* and 2*b*, the oblique part 8*c* of the plate 8 is provided with a passage opening 12 which is elongated in a direction perpendicular to the drawing plane. At this point, the plate 8 is deflected inward by edge strips 13*a* and 13*b*, which form a tapering entry opening for the image receiving material P, so that the latter can be controllably moved towards the nip between the fuser rollers 2*a* and 2*b*. This guidance is further assisted by the slightly deflected end parts 14*a* and 14*b* of the edge strips 13*a* and 13*b*, said parts 14*a* and 14*b* forming a passage in line with the nip of the fuser rollers 2*a* and 2*b*.

Near the bottom liquid container 28*b*, a downwardly opening outlet 11 is provided in the bottom second part 8*b* and leads into a reservoir 20 for release liquid, said reservoir being fixed to the bottom of the bottom step part 8*b*.

Figure 2:
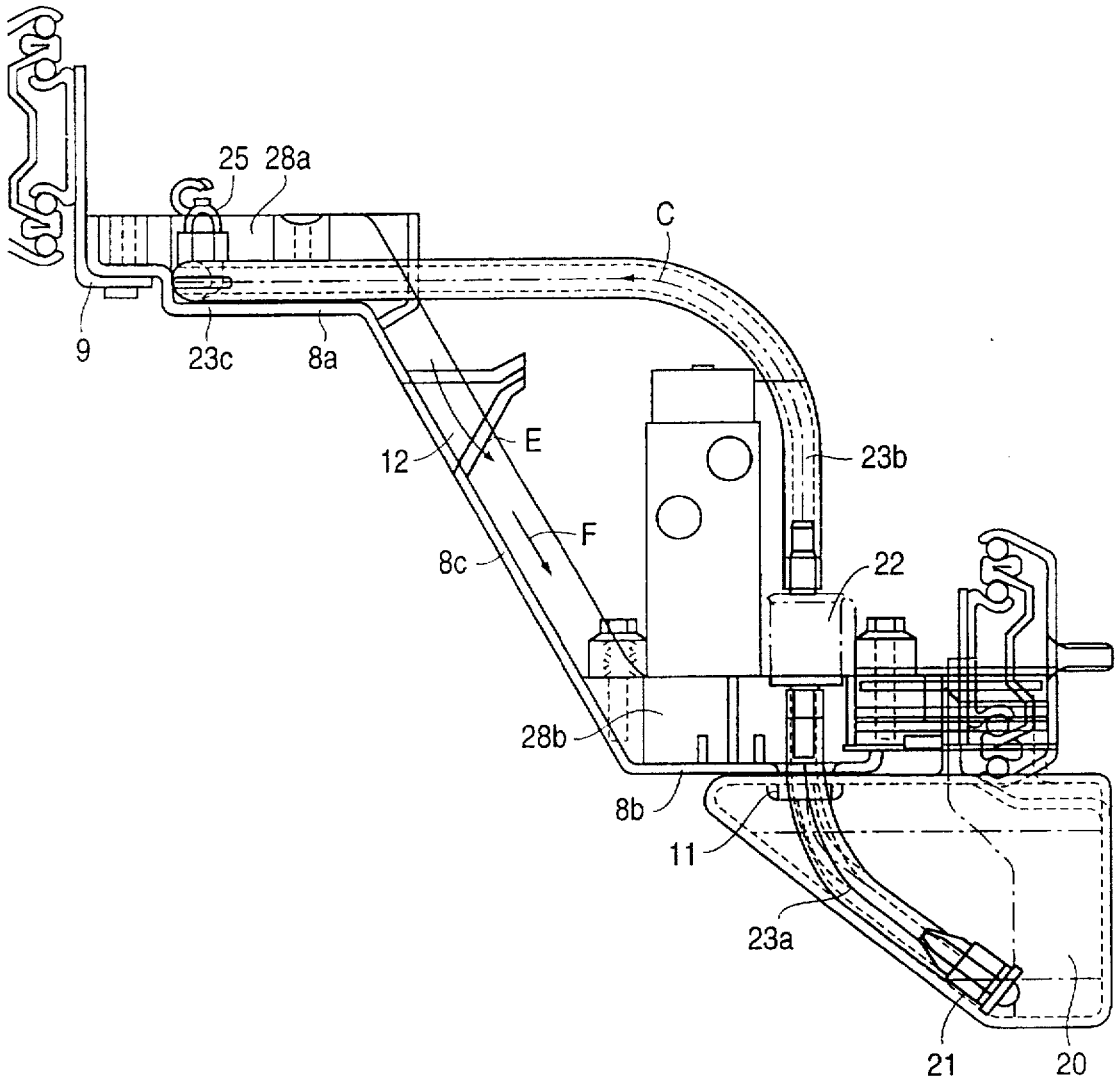
FIG. 2 is a diagrammatic vertical side elevation of a roller fuser assembly according to FIG. 1, other components also being shown.
Figure 3:
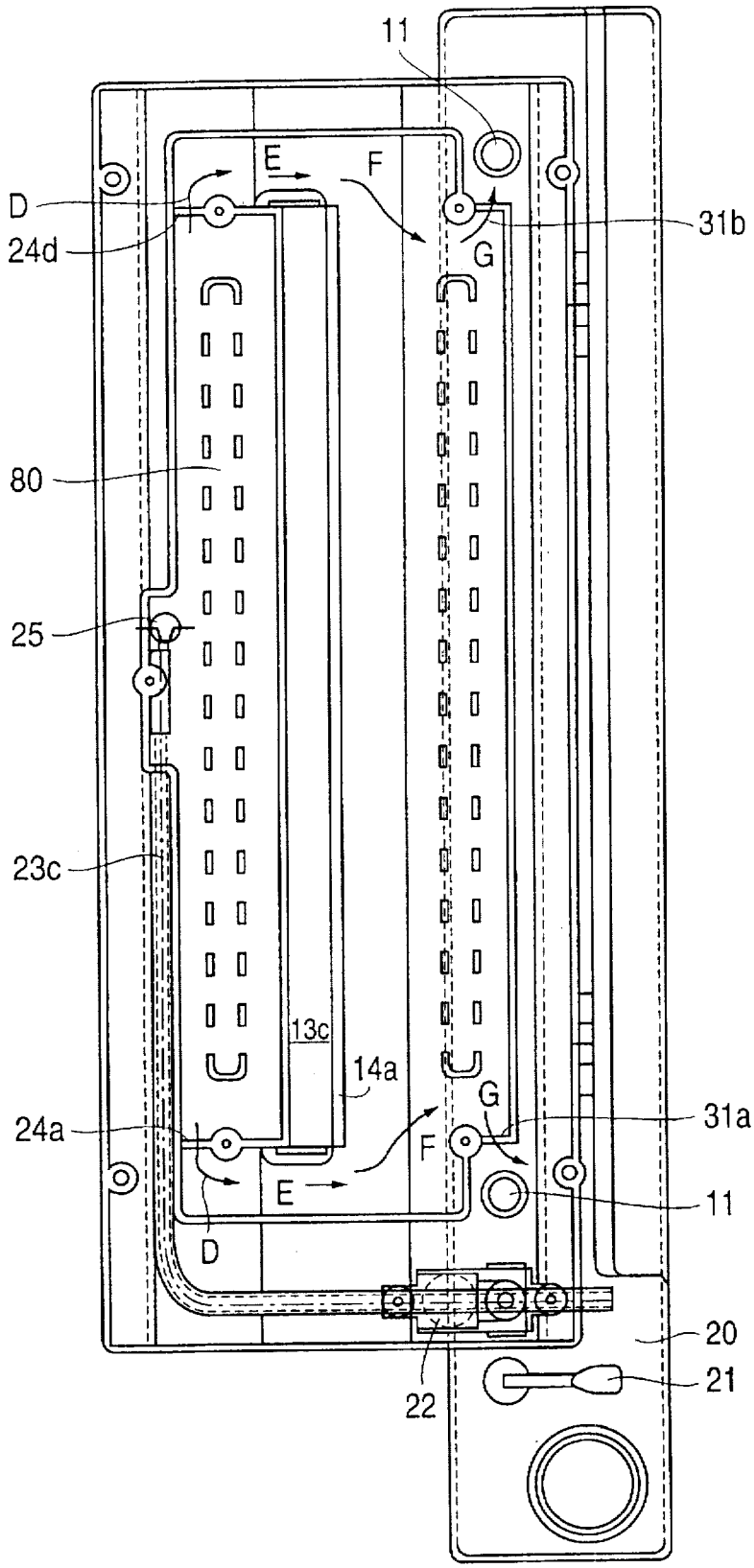
FIG. 3 is a top plan view of the assembly shown in FIG. 2.

The details of this are shown in FIGS. 2 and 3 respectively, in which the plate 8 is shown in side elevation and top plan view respectively, without the rollers but with the means for circulating the release liquid. A feed conduit 23*a* with an intake nozzle 21 is immersed in the reservoir 20. The feed conduit 23*a* leads to a pump 22 by means of which the release liquid is sucked out of the reservoir 20 and delivered through feed conduit 23*b* towards the region of the top liquid container 28*a* in the direction C. Here the release liquid is fed along the base, in the horizontal feed conduit 23*c*, to the outlet 25 and then flows into the top liquid container 28*a*.

A special feature is the fact that the feed conduit 23*a*–*c* is also used in the supply of release liquid to the bottom release liquid container 28*b*. An excess of release liquid is allowed to flow over the edge of the lowered end walls 24*a*, 24*b* of the liquid container 28*a* shown in FIG. 3, as indicated by arrows D in the drawings. It will be apparent from the drawings that the release liquid flows off in the directions E over the oblique plate part 8*c* and along the slit-shaped passage opening 12. Release liquid reaching the zone between the wall 29*a* of the container 28*a* and the top guide section 13*a* of the passage opening 12 is collected by the strip 13*a* and the slightly bent-up edge 14*a* thereof, so that this liquid cannot reach the passage opening 12 and leak downwards, but will flow away to the side to follow the main stream as shown by arrows E–F in FIG. 3. The release liquid then flows along the oblique wall 8*c* automatically into the bottom container 28*b*.

The bottom release liquid container 28*b* is also provided with an overflow for release liquid, at both end walls 31*a*, b so that the liquid can flow over in directions G and reach the outlet pipe openings 11 and then the reservoir 20.

Since the feed conduit 23*a–c* is also disposed above the plate 8, the release liquid circuit is leakage-free and any leakage from the feed conduit (e.g. after a fracture) is at least substantially directly collected by the plate 8 and fed back along the same to the reservoir 20. The construction of the plate 8 with the roller assemblies thereon as illustrated provides a compact fuser and after-fuser station which takes up little space in a reproduction system. If required, the fixing means and any drive means can also be mounted on the plate 8.

Of course the invention can also be embodied in other ways. For example, it is irrelevant how the release liquid is applied to the fuser rollers. It can also be effected by means of the known wicks.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A roller fuser assembly for reproduction systems comprising:

at least two fuser rollers, each of the fuser rollers having a pressure surface for pressing against a printing sheet fed therealong in order to fix toner images on at least one side of the printing sheet by pressure and heat;

means for applying a release liquid to the pressure surfaces of the fuser rollers;

a release liquid container for each fuser roller; and a release liquid collecting and discharge plate for interconnecting the at least two release liquid containers, the release liquid collecting and discharge plate discharging release liquid to at least one of the release liquid containers.

2. The roller fuser assembly according to claim 1, wherein the fuser rollers are disposed at different heights thereby providing at least a top fuser roller and a bottom fuser roller and wherein the collecting and discharge plate is connected, for release liquid flow, to the release liquid container of the bottom fuser roller.

3. The roller fuser assembly according to claim 2, wherein the bottom fuser roller is disposed obliquely beneath the top fuser roller.

4. The roller fuser assembly according to claim 3, wherein the release liquid container of the bottom fuser roller receives release liquid flowing along the collecting and discharge plate.

5. The roller fuser assembly according to claim 4, further comprising a release liquid reservoir and a feed conduit, the release liquid container of the top fuser roller having an overflow edge, the overflow edge being connected for discharge of release liquid to the collecting and discharge plate, the release liquid container of the bottom fuser roller having a discharge to the release liquid reservoir, and the feed conduit extending between the release liquid reservoir and the release liquid container of the top fuser roller whereby a fluid circuit is provided.

6. The roller fuser assembly according to claim 3, wherein the collecting and discharge plate forms an inclined plane.

7. The roller fuser assembly according to claim 6, wherein the release liquid container of the bottom fuser roller receives release liquid flowing along the collecting and discharge plate.

8. The roller fuser assembly according to claim 7, further comprising a release liquid reservoir and a feed conduit, the release liquid container of the top fuser roller having an overflow edge, the overflow edge being connected for discharge of release liquid to the collecting and discharge plate, the release liquid container of the bottom fuser roller having a discharge to the release liquid reservoir, and the feed conduit extending between the release liquid reservoir and the release liquid container of the top fuser roller whereby a fluid circuit is provided.

9. The roller fuser assembly according claim 8, wherein the collecting and discharge plate is provided with a passage opening for a printing sheet, and wherein in a processing direction, the passage opening is situated upstream of the fuser rollers.

10. The roller fuser assembly according to claim 9, further comprising means on the plate at the passage opening for keeping release liquid away from the passage opening.

11. The roller fuser assembly according to claim 10, wherein the means for keeping the release liquid away from the passage opening comprises a bent-over edge zone in the plate, the edge zone in the plate further forming a printing sheet guide in the passage opening.

12. The roller fuser assembly according to claim 8, wherein the release liquid containers and the collecting and discharge plate are formed as a unit with one another.

13. The roller fuser assembly according to claim 8, wherein the release liquid reservoir is fixed on the collecting and discharge plate.

14. The roller fuser assembly according to claim 13, wherein the feed conduit is fixed on and situated above the collecting and discharge plate.

15. The roller fuser assembly according to claim 14, further comprising pump means in the feed conduit, said pump means being fixed on the collecting and discharge plate.

16. The roller fuser assembly according to claim 1, further comprising a release liquid reservoir fixed on the collecting and discharge plate.

17. The roller fuser assembly according to claim 16, further comprising feed conduits for supplying release liquid from the reservoir to at least one of the release liquid containers, the feed conduits being fixed on and situated above the collecting and discharge plate.

18. The roller fuser assembly according to claim 17, further comprising pump means in the feed conduits, said pump means being fixed on the collecting and discharge plate.

19. The roller fuser assembly according claim 1, wherein the collecting and discharge plate is provided with a passage opening for a printing sheet, and wherein in a processing direction, the passage opening is situated upstream of the fuser rollers and wherein the assembly further comprises means on the plate at the passage opening for keeping release liquid away from the passage opening.

20. The roller fuser assembly according to claim 1, wherein the release liquid containers and the collecting and discharge plate are formed as a single one-piece unit.

* * * * *